US008866631B2

(12) United States Patent
Grimseth

(10) Patent No.: US 8,866,631 B2
(45) Date of Patent: Oct. 21, 2014

(54) SYSTEM AND METHOD FOR REMOTELY CONTROLLING DOWN-HOLE OPERATIONS

(75) Inventor: Tom Grimseth, Oslo (NO)

(73) Assignee: Vetco Gray Scandinavia AS, Sandvika (NO)

( * ) Notice: Subject to any disclaimer, the term of this patent is extended or adjusted under 35 U.S.C. 154(b) by 1336 days.

(21) Appl. No.: 12/295,552

(22) PCT Filed: Mar. 27, 2007

(86) PCT No.: PCT/IB2007/000760
§ 371 (c)(1),
(2), (4) Date: Sep. 30, 2008

(87) PCT Pub. No.: WO2007/116264
PCT Pub. Date: Oct. 18, 2007

(65) Prior Publication Data

US 2009/0295597 A1 Dec. 3, 2009

Related U.S. Application Data

(60) Provisional application No. 60/787,225, filed on Mar. 30, 2006.

(51) Int. Cl.
*G01V 3/00* (2006.01)
*E21B 34/16* (2006.01)

(52) U.S. Cl.
CPC ..... *E21B 34/16* (2013.01)
USPC ..... 340/853.3

(58) Field of Classification Search
USPC ..... 340/853.3, 855.5, 855.7
See application file for complete search history.

(56) References Cited

U.S. PATENT DOCUMENTS

| | | | | |
|---|---|---|---|---|
| 2,008,563 | A * | 7/1935 | Sarbey | 178/23 R |
| 7,038,332 | B2 * | 5/2006 | Robison et al. | 307/11 |
| 2003/0066652 | A1 | 4/2003 | Stegemeier et al. | |
| 2005/0088316 | A1 | 4/2005 | Mallison et al. | |
| 2005/0212526 | A1 * | 9/2005 | Blades | 324/543 |

OTHER PUBLICATIONS

PCT/ISA/210—International Search Report—Aug. 17, 2007.
PCT/IPEA/409—International Preliminary Report on Patentability—Jun. 2, 2008.

* cited by examiner

*Primary Examiner* — Shane Bomar
*Assistant Examiner* — Kipp Wallace
(74) *Attorney, Agent, or Firm* — Venable LLP; Eric J. Franklin

(57) ABSTRACT

A system for remote control of operation control elements that are arranged in a well to control recovery of gas and/or oil from the well. A first system part is located outside the well and connected to a second system part that is located in the well and operatively connected to the operation control elements. All semiconductor components are housed in the first system part. The second system part houses electromechanical components that actuate the operation control elements upon command from the first system part. A method for remote control of down-hole operation control elements in an oil and/or a gas well completion. A first system part located outside the well is equipped with all semiconductor components that are included in the system. A second down-hole system part is equipped with electromechanical components that are actuated from the first system part for actuation of the operation control elements.

15 Claims, 2 Drawing Sheets

SYSTEM AND METHOD FOR REMOTELY CONTROLLING DOWN-HOLE OPERATIONS

CROSS-REFERENCE TO RELATED APPLICATIONS

This application claims priority to U.S. provisional patent application 60/787,225 filed 30 Mar. 2006 and is the national phase under 35 U.S.C. §371 of PCT/IB2007/000760 filed 30 Mar. 2007.

FIELD OF THE INVENTION

The present invention relates to a system for remotely controlling one or more down-hole operations, such as functions of actuator means, typically control valves (comprising sliding sleeves), chokes and/or other mechanical types of equipment in an oil and/or a gas well completion. In correspondence therewith, the invention relates also to a method for remotely controlling one or more down-hole operations in an oil and/or a gas well completion.

BACKGROUND OF THE INVENTION

Oil and gas companies pursue to an ever increasing degree more functionality in wells, both land/platform and sub sea wells. The trend to implement multilateral capability (several well trajectories kicked off from a single drilling point and producing through the same well head (valve tree) is particularly determined. This approach to well completion requires means to close and open remotely the valves (sliding sleeves) isolating and connecting the various laterals with the main bore. For some completions choke valves could also be required. Further, down-hole production equipment, such as separation equipment, is required in some wells and may require remote control functionality. For all of these functions automatic, remote control is desirable, such as to prevent costly re-entry into the well. Due to space constraints in the tubing hanger area of a well, which limits the number of penetrations for electrical wires and hydraulic conduits, such remote control systems are required to be based on some form of multiplexing. Also, running a tubing string with a large number of cables/tubes in the annulus can be cumbersome and time consuming.

Several contractors have developed multiplexed control system for down-hole applications, mostly based on high temperature electronic circuitry designed and supplied by major international corporations especially for operation in hot environments. Such systems have achieved various degrees of success. However, all electronic circuitry have similarity in failure mechanisms and patterns, inherent in semiconductor devices. One characteristic is that it is impossible to predict the failure time of a given circuit. The failure of electronic circuitry tends to follow statistical models, inferring that some circuits may fail early and some (most) may perform fault free for many years.

This failure pattern is unfortunate in a down-hole application where the robustness of mechanical equipment with the inherent failure modes of mechanical components have demonstrated success as opposed to electronic circuitry which is still in the maturing process. Correctly designed and installed mechanical components will normally function for a period of time determined by wear, corrosion or erosion, depending on use and exposure.

SUMMARY OF THE INVENTION

There is thus a commercial demand and an object of the present invention to provide a down-hole control system and a method that entirely remedy the problems discussed above and related to failure modes of electronic circuitry operating in a hot environment.

This object is achieved according to the present invention by means of a system and a method.

Briefly, a system according to the present invention is designed for remote control of operation control means, such as valves, that are arranged in a well and effective for controlling the recovery of gas and/or oil from the well, the remote control system comprising a first system part located outside the well and connected to a second system part which is located in the well and operatively connected to the operation control means. The remote control system is characterized in that all semiconductor components comprised in the system are housed in the first system part, while the second system part houses electromechanical components that actuates the operation control means upon command from the first system part.

A down-hole electro-hydraulic, or all electric, control system according to the invention is preferably based on electrical current multiplexing. In other words, in the preferred embodiment the first system part comprises constant current generators operative for the supply of power and control signals to the electromechanical components and operation control means arranged in multiplexer configuration in the second system part.

Preferably, all down-hole components are mechanical or electromechanical, i.e. without any semiconductor devices in the down-hole system part. The method/system does not require semiconductor devices below e.g. a tubing hanger or in any hot environment. Preferably the dominant component comprised in the down-hole control multiplexer is an electromechanical relay, preferably fully encapsulated and designed for regular and prolonged operation at a temperature in the order of about 200° C. The relay may be a commercially available product, such as a relay available from Teledyne Inc., e.g., which is a proven provider of relays designed for down-hole signal applications.

The electromechanical components of the second system part comprises one or more sets of electromechanical relays, and the first system part comprises a constant current generator that is controllable for feeding a stepwise variable current for individual actuation of the electromechanical relays. Thus, the electromechanical relays are designed for high down-hole temperatures in combination with a constant current generator, the latter being located topsides or in a submerged or sub sea control module and thus in benign environment at lower temperatures. The constant current generator and the electromechanical relays may be interconnected through a cable located in an annulus of the well.

The electromechanical relays in a set are connected in series and actuated in consecutive order in result of increasing or decreasing impressed current. The electromechanical relays in a set are arranged, as seen in the direction of current, such that the electromechanical relays in an upstream location are actuated through a lower current than are the electromechanical relays in a downstream location.

The electromechanical relays in a set are associated with bypass resistors providing parallel paths of current to the electromechanical relays, by which resistors the sensitivity and required actuation power is individually established in each electromechanical relay. In such configuration, the electromechanical relays in a set may be identical, the resistors in parallel to the electromechanical relays may likewise be identical, and the current supplied may be stepwise variable at identical intervals.

In a system according to the invention, the electromechanical relays in a set form individual switches that control the supply of current to a corresponding set of operation control means, each of which is connected to one electromechanical relay for actuation. In order to effect the actuation of the operation control means, the first system part comprises a constant current generator which supplies operation power to the operation control means, and which is wired so as to individually actuate a selected operation control means.

A system according to the aforesaid is preferably assisted by an electric circuit that monitors the status of the set of electromechanical relays contained in the second system part, said monitoring circuit comprising a frequency sweep device arranged in the first system part. A set of loads, preferably each of individual characteristics, is connected to the frequency sweep device by means of auxiliary contacts for each electromechanical relay, such that a set of current, voltage, and/or phase distortion values is recordable for a given load and/or value of frequency which is characteristic for each individual electromechanical relay. Each set of load may be organized as a series connection of a resistor and an inductor in series with the cable reactance and in individual and different combinations for each electromechanical relay. The evaluation means are housed in the first system part for comparing the recorded values to a pre-recorded set of values by means of correlation techniques. The first and second system parts may be connected through a cable located in the annulus of the well.

Briefly, a method according to the invention comprises the basic steps of:

- equipping the first system part with all semiconductor components that are comprised in the system, and
- equipping the second system part with electromechanical components that are actuated from the first system part for actuation of the operation control means.

Further steps of advantageous and preferred embodiments comprise:

- arranging the electromechanical components and operation control means in multiplexer configuration in the second system part, and
- providing constant current generators in the first system part for supplying power and control signals to the electromechanical components and operation control means in the second system part;
- equipping the second system part with one or more sets of electromechanical relays connected in series, and
- feeding the electromechanical relays within each set from a constant current generator in the first system part, while stepwise controlling the output current for individual actuation of each electromechanical relay in the set in consecutive order as the result of stepwise increased or decreased impressed current;
- establishing the actuation sensitivity and power requirement of each electromechanical relay in a set by connecting bypass resistors in parallel with the electromechanical relays, and
- arranging the electromechanical arrays with bypass resistors such that, as seen in the direction of current, the electromechanical relays in an upstream location are actuated through a lower current than are the electromechanical relays in a downstream location.

In a system wherein the electromechanical relays in a set are identical, and the resistors in parallel to the electromechanical relays are identical, a preferred method further comprises the step of stepwise varying at identical intervals the actuation current for individual actuation of each electromechanical relay.

A method according to the present invention for remotely controlling operation of operation control means, such as valves, which are arranged in a well and are effective for controlling the recovery of gas and/or oil from the well, according to which method a first system part is provided outside the well and connected to a second system part provided in the well and operatively connected to the operation control means, may further include measures for monitoring the status of the set of electromechanical relays comprising the steps of:

- arranging a set of loads, preferably each of individual characteristics, in series with the cable reactance and in individual and different combinations for each electromechanical relay;
- connecting, through auxiliary contacts for each electromechanical relay, the sets of loads to a frequency sweep device housed in the first system part;
- exciting said set of loads with a frequency sweep generated by said frequency sweep device, and
- recording a set of current, voltage, and/or phase distortion values for a given load and/or value of frequency which is characteristic for each individual electromechanical relay, and preferably
- comparing, by means of correlation techniques, the recorded values to a pre-recorded set of values in evaluation means housed in the first system.

BRIEF DESCRIPTION OF THE DRAWINGS

Further explanation of features and advantages provided through the present invention will appear from the following detailed description of examples, with reference made to the drawings. In the drawings, FIG. 1 schematically illustrates various components of a preferred control system.

DETAILED DESCRIPTION OF PREFERRED EMBODIMENTS

In the following an electro hydraulic system is described by way of example. It should be noted that an all electric system could be based on the same multiplexer (MUX) technique.

A down-hole control system is subject to the following functional requirements:

1. extreme robustness and reliability in environments up to about 200 degrees C. and aggressive chemicals for a period of more than 30 years
2. typically 8-24 digital output signals down-hole (e.g. for 4-12 bidirectional actuators)
3. typically 8-24 solenoid drivers down-hole (e.g. for 4-12 bidirectional actuators)

Sluggish response times will be of little significance. Frequency of operation is usually quite low. Broad bandwidth is thus not required. Mechanical wear life of a relay is typically in the range of 1-10 million cycles, many times the number needed in the subject down-hole applications.

A preferred multiplexed electro-hydraulic control system typically comprises:

- at least two off Constant Current Generators (CCG), located in a first part of the system on a platform (for platform wells) or in the well control system control module (for sub sea wells);

connector and penetrator for Tubing Hanger (TH) penetrations and connections, both electrical and hydraulic;

electrical cable running from TH to a second part of the system located down-hole and further comprising:

a down-hole multiplexer decoder unit (MUX decoder);

a number of solenoid operated, hydraulic, directional control valves;

actuators to control position of sliding sleeves and choke valves.

A CCG is a standard electronic circuit and is traded in a number of designs. It provides a current according to the input signal (setpoint) independent of resistance/reactance in the circuit. The voltage is simply ramped up till the desired current is achieved, based on closed loop control.

Figure 1:
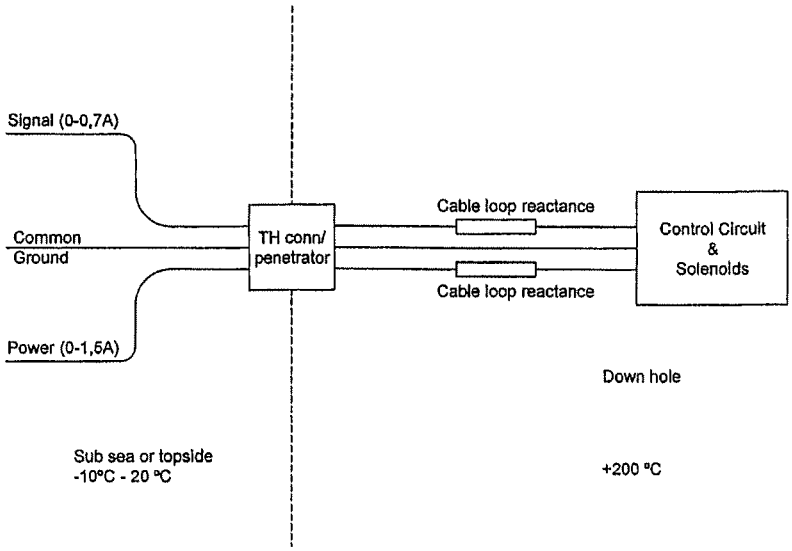
Figure 2:
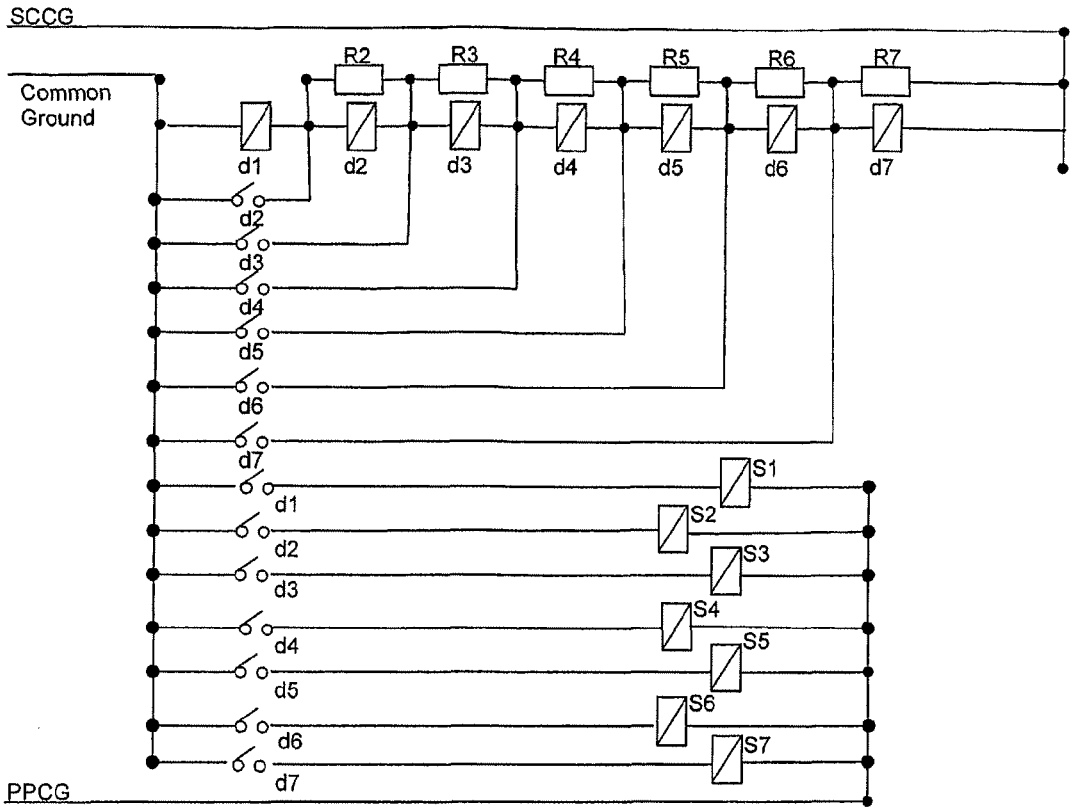
FIG. 2 is an example of a simplified circuit diagram of a down-hole multiplexer unit for the case of seven outputs.

The example case of FIGS. 1 and 2 are described in the following:

The Signal Constant Current Generator (SCCG) generates a ramp from 0 ampere to the maximum current required in the circuit. In the example suggested in FIG. 1 a maximum signal current required is 700 milliampere. With reference to FIG. 2 the example case has a number of relays connected in series, where the current from the SCCG is initially (starting from 0 ampere) conducted through all the relays. All the relay solenoids are identical and require a current of 100 milliampere to pull the relay. At 100 milliampere d1 will pull and the same current is passed through all the other relay coils. However, d2 through d7 have parallel resistors (indicated by R2 to R7 in FIG. 2) and thus get insufficient current to pull the solenoids. All relays have significant hysteresis, which is required to be considered carefully during design. However, this is a characteristic well know to the person skilled in circuitry design. For the proposed circuitry a certain hysteresis is required in order to secure a clearly defined status of each relay.

When the current is increased to 200 milliampere, d2 pulls and thus bypasses the coil d1 which is then deactivated. In steps of 100 milliampere each relay d3 through d7 will pull and deactivate the upstream relays, i.e. the amount of current ramped up from the SCCG will determine which one of the solenoids that is selected to be activated, with all the other coils either being bypassed or with parallel resistors taking too much of the current to permit the coil pulling.

This approach facilitates a remotely operated MUX system permitting an operator in a control room to select a relay for activation without activating other relays.

Control of the valve solenoids S1 through S7 is provided by means of the Power Constant Current Generator (PCCG) which activates the selected valve solenoid by means of the contacts (d1 to d7) of the selected relay (d1 to d7). The PCCG is preset to provide the current required for activation of a valve solenoid, e.g. 1-1.5 ampere for a small solenoid.

Three wires are required to effectuate the suggested circuits, i.e. one common ground, one for the SCCG and one for the PCCG.

The relays offered for this type circuitry are very small in size and suitable for mounting on a printed circuit board (PCB), in a style as is common for electronic circuitry.

For the case at hand and environment at approximately 200° C. the common practise of soldering components on to a PCB may not be appropriate as the soldering may not withstand vibrations at this temperature. It is thus proposed to connect the legs of the relays to electrically conducting rails (simulating the circuit copper paths of a PCB) by mechanical means or by welding. Since this is a DC (Direct Current) operation, stray capacitive and inductive effects are of little significance in slow operation, thus the geometry of conductor paths and relay locations may be optimised for space effective packaging in a canister at typically atmospheric pressure, in a fashion common for design of sub sea SEMs (Subsea Electronic Modules—the computer part of a control module). DC operation also alleviates any constraints related to capacitive and inductive effects in the down-hole control cable (assuming slow operation), thus the system may be analysed as a resistive electric circuit and only be constrained by cable ohmic resistance.

The resistors may be constructed from simple resistor wire and insulated by means of a high temperature cable insulating material such as Tefzel® (product of DuPont™) or similar insulating materials, designed for use e.g. on aircraft, and designed to resist fire for a certain period of time. Such materials are now commercially available at moderate cost in quantities needed for a multiplexer.

Figure 3:
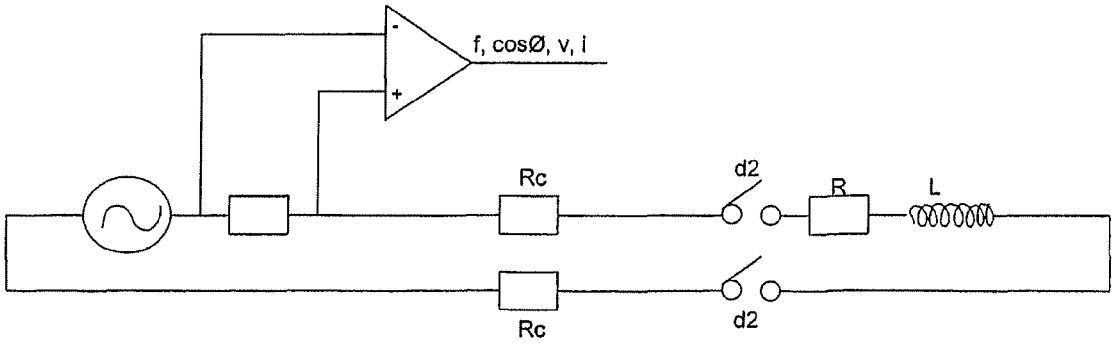
FIG. 3 is a simplified schematic of a position monitoring system for sliding sleeve or choke valve position.

A useful feature of a control system is the capability to monitor correct address and command before execution. In the present invention, this feature may be provided by an auxiliary circuit as described with reference to FIG. 3.

A current generator and frequency sweeper circuit (third current generator) provides excitation of the auxiliary circuit over a range of frequencies and passes a current through the cable conductors of loop resistance 2×Rc to the load. The cable connection requires an additional $4^{th}$ wire and uses common ground as return. The maximum number of channels in current design of penetrators for tubing hanger penetrations is four. Relay auxiliary contacts of the selected relay provide connection to a load organised as a series connection of a resistor and an inductor in series with the cable reactance (both easily constructed for hot environment). By organising different combinations of these two elements for each command (each relay d2-d7), and exciting the selected load with a frequency sweep, the characteristic combination of current, voltage and phase distortion can be recorded, stored and compared by means of correlation algorithms to the prerecorded set of the same parameters recorded at FAT (Factory Acceptance Tests). Thus the correct selection of a relay can be confirmed, still without the benefit of semiconductor devices in the hot environment of a down-hole well completion.

The system may only accommodate a limited number of digital output signals and may be sluggish in response to commands. However, both of these limitations are acceptable in a down-hole control system. The basic advantages achieved are extreme robustness and reliability as the typical failure modes of electronic circuitry in a hot environment are replaced by the more acceptable failure modes of mechanical equipment.

The present invention is of course not in any way restricted to the preferred embodiments described above. On the contrary, many possibilities to modifications thereof will be apparent to a person with ordinary skill in the art without departing from the basic idea of the invention as defined through the appended claims.

The invention claimed is:

1. A system for remote control of operation control elements that are arranged in a well to control recovery of gas and/or oil from the well, said remote control system comprising:

a first system part located outside the well, the first system part comprising a constant current generator;

a second system part located in the well and electrically connected to first system part, wherein the constant current generator of the first system part is controllable for feeding a stepwise variable current to the second system part, wherein all semiconductor components of the remote control system are housed in the first system part, and wherein the second system part houses at least one set of electromechanical relays operatively connected to the operation control elements, wherein the electromechanical relays are connected in series and are individually actuated in consecutive order in response to increasing or decreasing current supplied from the first system part to actuate the operation control elements upon command from the first system part; and an electric monitoring circuit that monitors a status of the at least one set of electromechanical relays contained in the second system part, wherein said monitoring circuit comprises a frequency sweep device arranged in the first system part, wherein a set of loads is connectable to the frequency sweep device with auxiliary contacts for each electromechanical relay, such that a set of current, voltage, and/or phase distortion values is recordable for a given load and/or value of frequency which is characteristic for each individual electromechanical relay.

2. The system according to claim 1, wherein the constant current generator is operative to supply power and control signals to the electromechanical relays and operation control elements arranged in multiplexer configuration in the second system part.

3. The system according to claim 1, wherein the at least one set electromechanical relays are arranged, as seen in a direction of current, such that the electromechanical relays in an upstream location are actuated through a lower current than are the electromechanical relays in a downstream location.

4. The system according to claim 1, wherein the at least one set electromechanical relays are associated with bypass resistors providing parallel paths of current to the electromechanical relays, by which resistors the sensitivity and required actuation power is individually established in each electromechanical relay.

5. The system according to claim 4, wherein the electromechanical relays in a set are identical, wherein the resistors in parallel to the electromechanical relays are identical, and wherein the current supplied is stepwise variable at identical intervals.

6. The system according to claim 1, wherein the at least one set electromechanical relays form individual switches that control the supply of current to a corresponding set of operation control means, each of which is connected to one electromechanical relay for actuation.

7. The system according to claim 6, wherein the first system part comprises a constant current generator which supplies actuation power to the operation control elements, and which is effective for individually actuating a selected operation control elements.

8. The system according to claim 1, wherein each set of loads is organized as a series connection of a resistor and an inductor in series with a cable reactance and in individual and different combinations for each electromechanical relay.

9. The system according to claim 1, further comprising:

an evaluation module housed in the first system part for comparing the recorded values to a pre-recorded set of values with correlation techniques.

10. The system according to claim 1, wherein the first and second system parts are interconnected through a cable located in an annulus of the well.

11. A method for remote control of operation control elements that are arranged in a well to control recovery of gas and/or oil from the well, the method comprising:

providing a first system part outside the well, providing a second system part in the well, electrically connecting the first system part and the second system part, equipping the first system part with all semiconductor components that are comprised in the system and a constant current generator that is controllable for feeding a stepwise variable current to the second system part, equipping the second system part with at least one set of electromechanical relays connected in series and operatively connected to the operation control elements, monitoring a status of the at least one set of electromechanical relays contained in the second system part with an electric monitoring circuit comprising a frequency sweep device arranged in the first system part, controlling an output current from the constant current generator for individual actuation of each electromechanical relay in consecutive order in response to increasing or decreasing current supplied from the first system part, to actuate the operation control elements upon command from the first system part, and monitoring the status of the at least one set of electromechanical relays, by arranging a set of loads, preferably each of individual characteristics, in series with the cable reactance and in individual and different combinations for each electromechanical relay, connecting, through auxiliary contacts for each electromechanical relay, the sets of loads to a frequency sweep device housed in the first system part, exciting said set of loads with a frequency sweep generated by said frequency sweep device, and recording a set of current, voltage, and/or phase distortion values for a given load and/or value of frequency which is characteristic for each individual electromechanical relay.

12. The method according to claim 11, further comprising:

arranging the electromechanical components and operation control elements in multiplexer configuration in the second system part, wherein the constant current generators in the first system part supply control signals to the electromechanical relays and operation control elements.

13. The method according to claim 11, further comprising:

establishing the actuation sensitivity and power requirement of each electromechanical relay in a set by connecting bypass resistors in parallel with the electromechanical relays, and arranging the electromechanical relays with bypass resistors such that, as seen in a direction of current, the electromechanical relays in an upstream location are actuated through a lower current than are the electromechanical relays in a downstream location.

14. The method according to claim 13, wherein the electromechanical relays in a set are identical, and the resistors in parallel to the electromechanical relays are identical, the method further comprising:

feeding actuating current at identical intervals of stepwise variable current for individual actuation of each electromechanical relay.

15. The method according to claim 11, further comprising:

comparing utilizing correlation techniques the recorded values to a pre-recorded set of values in an evaluation module housed in the first system.

* * * * *